US006723968B2

(12) United States Patent
Danko et al.

(10) Patent No.: US 6,723,968 B2
(45) Date of Patent: Apr. 20, 2004

(54) CONDUCTIVE U-SHAPED JUMPER STRAP AND METHOD OF USE

(75) Inventors: Michael Danko, Cookeville, TN (US); Jimmy L. Sherrill, Cookeville, TN (US); Keith Howard, Cookeville, TN (US)

(73) Assignee: Tutco, Inc., Cookeville, TN (US)

( * ) Notice: Subject to any disclaimer, the term of this patent is extended or adjusted under 35 U.S.C. 154(b) by 0 days.

(21) Appl. No.: 10/423,000

(22) Filed: Apr. 25, 2003

(65) Prior Publication Data

US 2003/0192877 A1 Oct. 16, 2003

Related U.S. Application Data

(63) Continuation of application No. 10/132,698, filed on Apr. 26, 2002, now Pat. No. 6,593,554.
(60) Provisional application No. 60/286,661, filed on Apr. 27, 2001.

(51) Int. Cl.[7] ..... H05B 3/06
(52) U.S. Cl. ..... 219/536; 219/538; 219/541; 219/404; 219/459.1; 219/520; 373/119; 373/1; 373/128; 392/487; 338/316; 338/318
(58) Field of Search ..... 219/536, 538, 219/541, 442, 537, 404, 402, 459.1, 408, 520, 532; 373/119, 1, 128–131; 392/487; 338/316–320

(56) References Cited

U.S. PATENT DOCUMENTS

| | | | | |
|---|---|---|---|---|
| 3,631,525 A | | 12/1971 | Brasch | |
| 3,641,312 A | | 2/1972 | Ammerman et al. | |
| 3,811,031 A | | 5/1974 | McBride et al. | |
| 4,289,955 A | | 9/1981 | Seeley | |
| 4,472,624 A | | 9/1984 | Janning | |
| 4,617,547 A | | 10/1986 | Howard et al. | |
| 5,181,318 A | * | 1/1993 | Janota et al. | 29/882 |
| 5,641,420 A | | 6/1997 | Peterson et al. | |
| 5,925,273 A | | 7/1999 | Sherrill | |
| 6,020,577 A | | 2/2000 | Barker | |
| 6,097,003 A | | 8/2000 | Markum et al. | |
| 6,433,318 B2 | | 8/2002 | Danko | |

* cited by examiner

*Primary Examiner*—Shawntina Fuqua
(74) *Attorney, Agent, or Firm*—Clark & Brody

(57) ABSTRACT

A conductive metal jumper strap has a plate portion with a pair of connection legs forming a u-shape. The connection legs are adapted to connect to terminals to make an electrical connection between two components of a heating device. The plate portion has a bend in it to allow flexing so that the connection legs can make a jumper connection between terminals where the terminal spacing may vary between heating devices.

8 Claims, 4 Drawing Sheets

CONDUCTIVE U-SHAPED JUMPER STRAP AND METHOD OF USE

This application is a continuation of application Ser. No. 10/132,698, filed Apr. 26, 2002, now U.S. Pat. No. 6,593, 554 and claims the benefit of U.S. Provisional Application No. 60/286,661, filed on Apr. 27, 2001.

FIELD OF THE INVENTION

The present invention is directed toward an electric heating apparatus and, more particularly, to an electric heating apparatus having a resistance wire with at least one of a thermostatic electric current control and temperature sensitive fuse.

BACKGROUND OF THE INVENTION

Electric heater assemblies having a resistance wire heating element and a thermostatic electric current control device, or thermostat, for controlling the electric current through the resistance wire based on the sensed temperature proximal to the same, are known in the art. Also known in the art are electric heater assemblies having a temperature sensitive fuse, or temperature cutout ("TCO"), to disconnect the resistance wire from its current source in response to overheating.

One well known connection and mounting structure for heater thermostats includes a housing enclosing a current control mechanism, with two conducting terminals, or flanges, that extend from the current control mechanism out through the housing. A right-angled two-pronged fork is formed at the distal end of each of the thermostat's extending flanges. A pair of threaded screw or bolt ends are supported by a corresponding pair of ceramic bushings, each mounted to the frame of the heater assembly, so that the two screws or bolt ends are aligned on the same axis.

The above-described thermostat is mounted by orienting it such that the threaded screws or bolt ends extend through the prongs of the terminal ends, whereupon a nut and associated series of washers is threaded onto each of the threaded screws or bolt ends and tightened. This sandwiches the fork between the nut and a face of the ceramic bushing, which secures the thermostat.

A co-pending application for patent describes a novel method and apparatus which has a reduced parts count and is easier to assemble than the above-identified structure. More particularly, the improved mounting structure uses a thermostat housing with two flanges, each having a through hole extending normal to the extending direction of the flange. A pair of ceramic bushings are mounted to the heater frame. Instead of threaded screws extending through the ceramic bushings, though, a terminal plate extends through each bushing. One end of each terminal plate has a through hole normal to the longitudinal axis of the plate. The other end is formed for crimping onto a wire conductor.

The first thermostat mounting assembly identified above requires complex forked-shape terminal extensions, and typically at least four nuts and at least eight washers. In addition, the assembly typically requires a time consuming manual labor. The invention described by co-pending U.S. application Ser. No. 09/852,947, on the other hand, requires only two screws, two terminal plates, and two support bushings to mount the thermostat.

The invention described by co-pending application Ser. No. 09/852,947, although it provides significant reduction in parts count and is easier to assemble than its prior art, may not be preferred for all uses. One reason is that both it and its described prior art mount use the thermostat terminals as load-bearing members. This necessitates terminals with sufficient structure to support the mass of the thermostat. In addition, both of the above-described structures place a temperature cutout ("TCO") in-line with the thermostat. The first described structure typically secures one wire terminal of the TCO, by crimping or soldering, to one end of an external connection terminal plate which, and secures the other wire terminal of the TCO to the head of one of the screws supported by a ceramic bushing. The structure described in co-pending application Ser. No. 09/852,947 secures one wire terminal of the TCO to one end of an external connection terminal plate, by crimping or soldering, and crimps the other wire terminal of the TCO within the crimping end of one of the terminal plates. In both structures the TCO is suspended between a pair of ceramic bushings.

As can be understood from the description above, it is often necessary to electrically interconnect the resistive heating wire either to a TCO or a thermostat, or both, on the same assembly. The electrical interconnects are generally achieved using flexible electrical wires, having metal terminals attached at one or both ends, the metal terminals connecting to a heating element terminal and to a terminal of the thermostat or TCO.

Various safety requirements exist which specify spacing between electrical conductors, such as between the exposed terminals of the thermostat and the heater support frame. To meet these requirements the existing terminal blocks for TCOs have large and bulky shapes and space-occupying features. Frequently these bulky shapes require that the terminal block have a large size as well, thereby occupying valuable space on the terminal plate.

TCOs generally have wire electrical leads extending from the TCO body. Terminals are typically connected to the wire electrical leads, by one of two methods generally known in the existing art. The first is by soldering or brazing. The second is by resistance welding. Both of these methods, however, have related problems with breaking, especially under mechanical stress. Mechanical stress may occur at the time of assembly, or during subsequent operation. The latter is a particular issue with heating apparatuses, due to the repeated stress cycles of thermal expansion and contraction during operation. The thermal stress places an increased burden on manufacturing quality which in turn, exacerbates any problems relating to inspection.

More particularly, the ability of the soldered, brazed or welded joint to withstand such stress is substantially tied to the quality of the soldering, brazing or welding. Controlling the quality can be difficult, because destructive testing may be the best way to reliably test the quality of soldered or welded joints.

SUMMARY

One embodiment of the present invention provides a heater assembly, including a mounting assembly, a temperature-sensitive current cut-off structure, a unitary conducting jumper, a first, second, and third terminal structures, a heating element, and an insulator support structure including a first, second, and third terminal receiving openings formed therethrough. The insulator support structure is releasably and fixedly secured to the mounting assembly. The first terminal receiving opening of the insulator support structure cooperates with the first terminal structure to secure the first terminal structure to the mounting assembly. The second terminal receiving opening of the insulator support structure cooperates with the second terminal structure to secure the second terminal structure to the mounting assembly. The third terminal receiving opening of the insulator support structure cooperates with the third terminal structure to secure the third terminal structure to the mounting assembly. The heating element is releasably and fixedly secured to the mounting assembly, and coupled to the first terminal structure. The unitary conducting jumper is secured to the first terminal structure and to the second terminal structure. The temperature-sensitive current cut-off structure is crimped to the second terminal structure and to the third terminal structure.

DETAILED DESCRIPTION

Figure 1A:
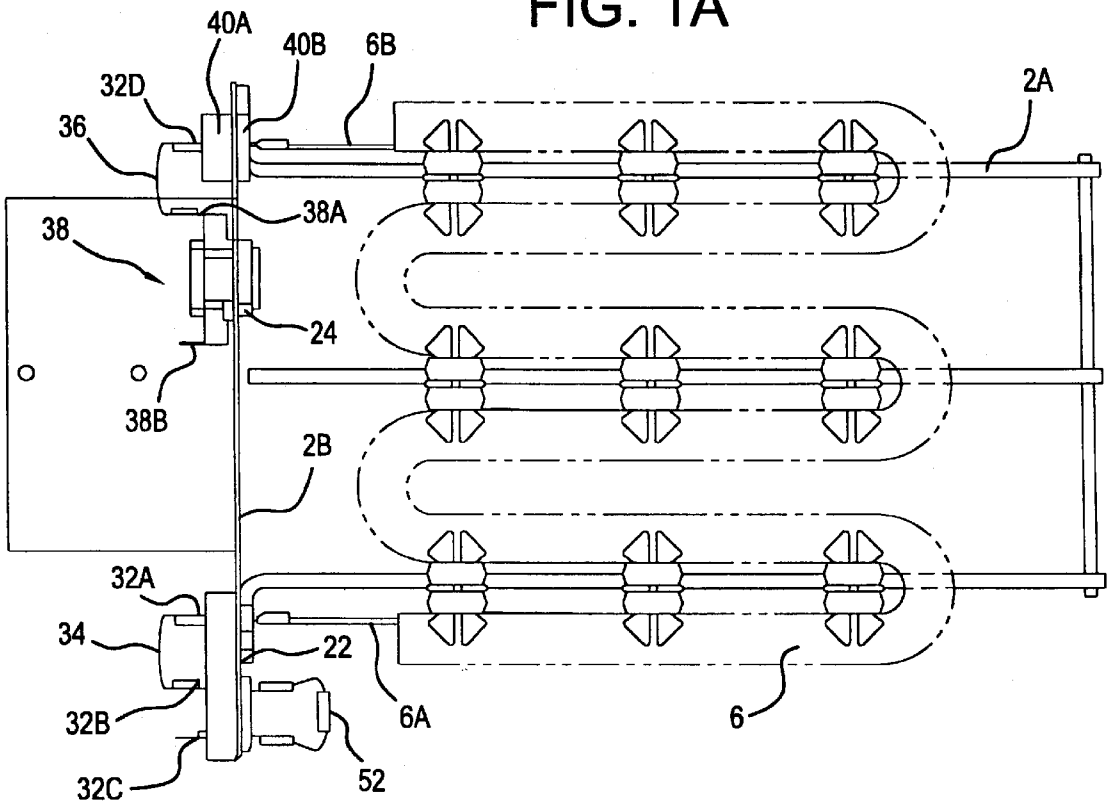
FIGS. 1A, 1B, and 1C show a side view, a front view, and a top view, respectively, of an embodiment of a heater assembly.

In view of the above-identified and other shortcomings in the prior art, an object of the present invention is a method and apparatus for mounting and electrically connecting a TCO and a thermostat into a heater assembly using minimal parts count and minimal assembly steps.

A further object of this invention is a method and apparatus for mounting and electrically connecting a TCO and a thermostat into a heater assembly in accordance with the object identified above, and further including universal terminal members for attaching to TCO or thermostat terminals, and a unitary connecting strap for connecting same.

A still further object of this invention is a method and apparatus for mounting and electrically connecting a TCO and a thermostat into a heater assembly in accordance with one or more of the objects previously identified, further providing a unitary connecting strap configured to also accommodate thermostat terminals, for connecting thermostat terminals and universal terminal members of varying relative heights.

Another object of this invention is a method and apparatus for mounting and electrically connecting a TCO and a thermostat into a heater assembly in accordance with one or more of the previously identified objects and further providing for mounting a thermostat to a frame of the heater apparatus using a single threaded screw.

Another object of this invention is a method and apparatus for mounting and electrically connecting a TCO and a thermostat into a heater assembly in accordance with one or more of the previously identified objects and further providing a mechanical connection of the universal terminal member to the terminal of a TCO or a thermostat, the structure and method of the connection providing for non-destructive verification of its security.

Another object of this invention is a method and apparatus for mounting and electrically connecting a TCO and a thermostat into a heater assembly wherein the mechanical connection of the universal terminal member to the terminal of a TCO or a thermostat is stronger, and more readily removed for field replacement than a welded, soldered and brazed connection.

An example embodiment of the invention, which is directed to the above-identified objectives, includes a support frame having a plate with structure for supporting a resistive heating wire and having a plate with a plurality of clearance holes or cut-outs. An insulating multi-terminal block having a top surface, a bottom surface, and a plurality of first through holes extending from the top surface to the bottom surface is attached to the plate such that the first through holes line up with the clearance holes or cut-outs.

A plurality of terminal members, each having a connection structure at one end, and a crimping structure at an end opposite the one end, extends through a corresponding plurality of the first through holes in the insulating multi-terminal block. Each terminal connection member extends through a corresponding cut-out in the frame plate. Each terminal member has an axial securing structure which, in cooperation with the insulating multi-terminal block, locates and secures the terminal member such that its connection structure extends above the top surface of the insulating multi-terminal block, and its crimping structure extends outward in the opposite direction through the bottom of the insulating multi-terminal block, and though a cutout in the frame plate.

A temperature sensitive fuse having a first wire terminal and a second wire terminal is connected to a first and a second of the terminal members, by the first wire terminal being crimped within the crimping structure of the first terminal member, and the second wire terminal being crimped within the crimping structure of the second of the terminal members. The first and second wire terminals are dimensioned and formed such that a portion of the temperature sensitive fuse is proximal to a portion of the resistive heating wire.

A unitary jumper strap, having a first means for removably engaging with the connection structure of the third terminal member, a second means for removably engaging with the connection structure of the second terminal member, and an electrical conducting member extending from the first means to the second means, is connected between the connection end of the third terminal member and the connection end of the second terminal member.

A further embodiment of the invention, in accordance with the above embodiment, is structured such that the axial support of the terminal members includes a fixed securing abutment disposed proximal to one of the connection tab and the crimping tab, and a bendable securing abutment disposed proximal to the other of the connection structure and the crimping structure.

A further embodiment of the invention includes a frame plate with structure for cooperatively engaging with a thermostat and an insulating terminal bushing. A thermostat, having a body flange and a first and second terminal is secured to the frame plate by a mounting screw. The insulating terminal bushing includes a terminal member through hole for supporting another of the terminal members. A fourth terminal member, preferably identical to the terminal members of the previous embodiments, is secured within the insulating terminal bushing by the above-described axial securing structure. A unitary jumper strap, preferably identical to the unitary jumper strap of the previous embodiments, connects to the connection structure of the fourth terminal member and to one of the terminals of the thermostat. Another terminal of the resistive heating wire is crimped within the crimping structure of the terminal member.

The apparatus of this invention provides significant reduction in the number of parts required to mount the TCO and external connection to the electric heater assembly.

These and other objects, features and advantages of the present invention will become more apparent to, and better understood by, those skilled in the relevant art from the following more detailed description of the preferred embodiments of the invention taken with reference to the accompanying drawings, in which like features are identified by like reference numerals.

Figure 1B:
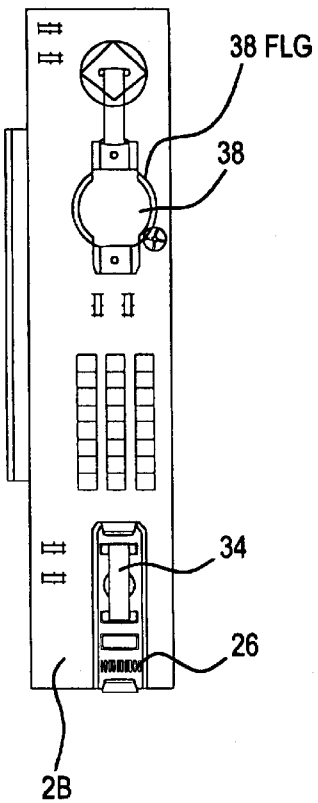
Figure 1C:
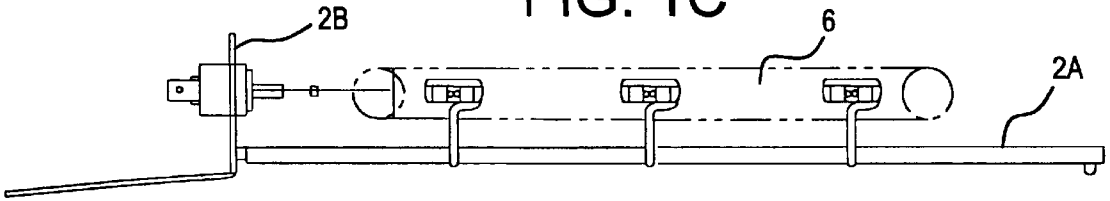
Figure 2:
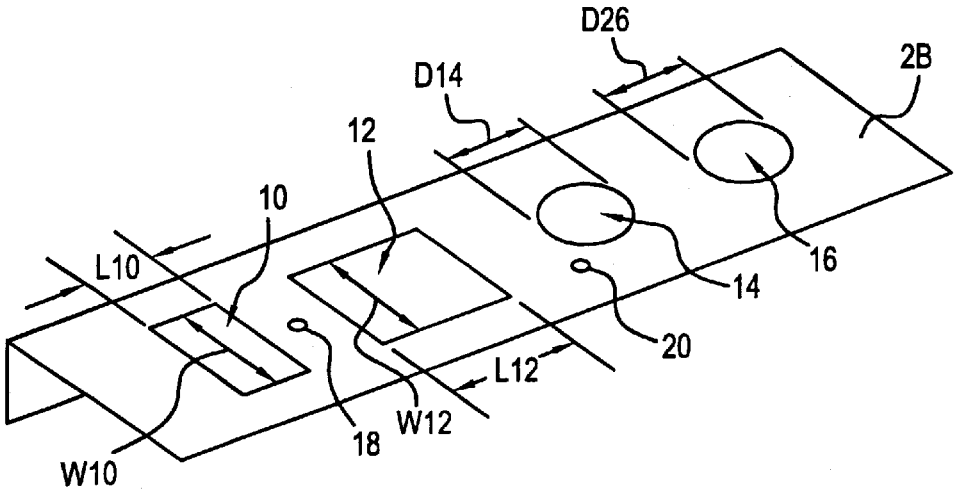
FIG. 2 shows a perspective view of a frame portion of the heater assembly of FIG. 1, prior to installation of certain depicted structures.

Referring to FIGS. 1 and 2 a first example embodiment of the invention will be described. FIG. 2 shows a portion of the structure depicted by FIG. 1 prior to installation of the described components.

This example embodiment includes a frame 2 (e.g., a mounting assembly), having a resistive heater element support frame 2A and a frame plate 2B. The resistive heater element frame 2A, for this example, includes a plurality of rods welded to the frame plate 2B, each rod supporting a plurality of ceramic supports which, in turn, support a resistive heater element 6. The resistive heater element 6 has a first terminal end 6A and a second terminal end 6B. The arrangement and structure of the resistive heater element support frame 2A, and resistive heater element 6 are for purposes of example only, and are not specific to this invention. Many structures for securing a resistive heating element to a frame are known to persons of ordinary skill in the relevant arts.

Referring to FIG. 2, the frame plate 2B has a first cut-out 10, a second cut-out 12, a third cut-out 14 and a fourth cut-out 16. As will be understood by reading this description, the relative shape, arrangement, and population of the cut-outs, of which cut-outs 10–16 are examples, is a design choice driven, in part, by the shape and dimension of other components and structures described below. Cut-out 10 is rectangular with a width W10 and a length L10, cut-out 12 is also rectangular with a width W12 and a length L12. Cut-out 14, for this example, is circular, with diameter D14. Cut-out 16 is circular, with a diameter D16

A mounting hole 18 is located between cut-outs 10 and 12, and a mounting hole 20 is located proximal to the cut-out 14. As shown in FIG. 1, the mounting holes 18 and 20 are for mounting screws 22 and 24 which are described below. Depending on design choice and particular type of said mounting screws selected, the mounting holes 18 and 20 may be clearance holes or may be dimensioned for self-threading screws.

Figure 3A:
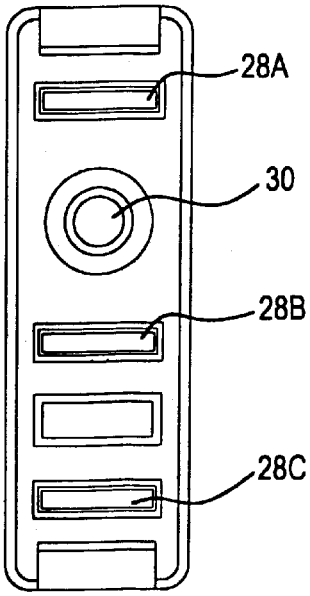
FIGS. 3A, 3B, 3C show a front, side and rear view, respectively, of a terminal block of the heater assembly of FIG. 1.
Figure 3B:
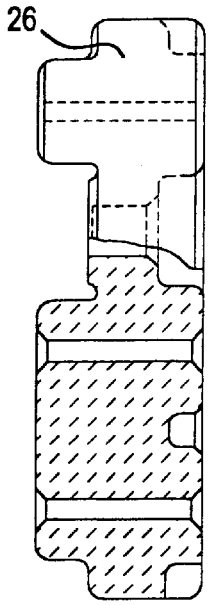
Figure 3C:
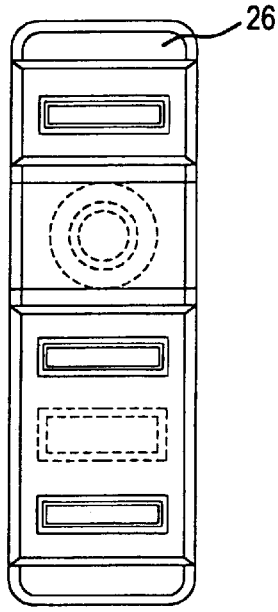

Referring to FIGS. 1 and 3, a first insulating terminal block 26, having a plurality of terminal through holes, labeled 28A through 28C, and a mounting hole 30, is mounted to the frame plate 2B by the mounting screw 22, which is threadably engaged with the mounting hole 18. The first insulating terminal block 26 is preferably ceramic.

Referring to FIG. 3, the first insulating terminal block 26 has a top, a supporting bottom portion, a first protruding bottom portion, and a second protruding bottom portion. The major height of the insulating block 26 is from its top, to either of the first and second protruding bottom portions. An example dimension is 9/16 of an inch. The height of the step from the first and second protruding bottom portions to the supporting bottom portion is typically about 1/8 of an inch more than the thickness T of the frame plate 2B.

The first terminal through hole 28A is substantially aligned on center with the first protruding bottom portion. The second and third terminal through holes are aligned with second protruding bottom portion. Preferably, all of the terminal through holes, i.e., 28A–28C, have identical dimensions. The spacing distance between terminal through holes may be determined by the dimensions of the installed components and structures described below. Example dimensions are 7/8 of an inch and 9/16 of an inch.

Referring to FIG. 1, a first, second and third terminal member, labeled 32A, 32B and 32C, respectively, extend through the terminal through holes 26A, 26B and 26C, respectively. Further to the objectives of this invention, terminal members 32A, 32B and 32C are preferably of common structure and dimension. An example of such a common structure terminal member is shown as item 32 in FIG. 4. As shown, the terminal member 32 has a connection end, a crimping end, a pair of abutments, and a pair of bendable tabs.

Figure 4A:
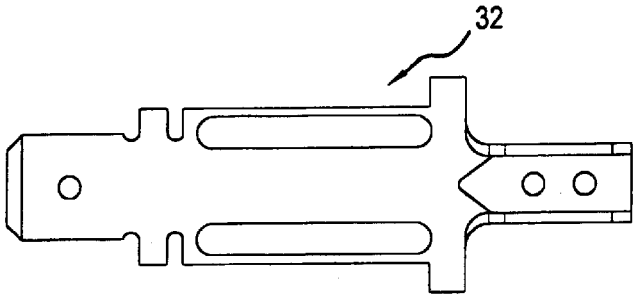
FIGS. 4A, and 4B show a top, and side view, respectively, of a terminal member of the heater assembly of FIG. 1.
Figure 4B:
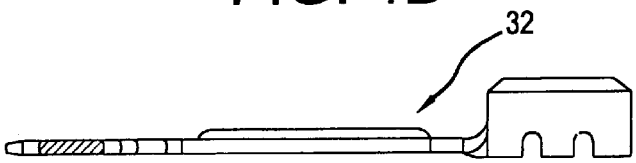

Referring to FIGS. 3, and 4, and comparing the dimensions of the tab 32 to the dimensions of the terminal though holes 28 in the multi-terminal block 26, the width of the tab is slightly less than the width of the through holes, while the thickness is slightly less than the height of the terminal through holes 28. The width spanned by the abutments is greater than the width of the through holes 28 in the multi-terminal block 26, while the dimension between the first abutments and the bendable tabs is slightly greater than the height of the though-holes.

Referring to FIGS. 1, 3, and 4, the deformable securing tabs of the terminal mounting member 32 have an initial height dimension, which is less than the height of the terminal through holes 28. This allows the terminal mounting members to be inserted through the terminal through holes bushing until the abutment tab contacts the face of the multi-terminal block 26. The abutment contacts the lower face of the multi-terminal block 26 securing tabs are just beyond the upper face. Then, the deformable securing tabs are bent, or otherwise deformed using, for example, a pair of needle-nosed pliers, to have the form shown in FIGS. 1 and 5. The terminal members 32 are thereby secured within the multi-terminal mounting block 26.

Referring to FIGS. 2 and 3, the width and length of the first protruding bottom portion are each slightly less than the width and length of the first cut-out 10. Similarly, the width and length of the second protruding bottom portion are each slightly less than the width and length of the second cut-out 12. The difference therebetween may provide enough clearance for the protruding bottom portions to extend through the cut-outs 10 and 12, and to allow for the positioning as shown in FIG. 1, without a force fit. As a result of the cooperation between the protruding bottom portions, and the first and second cutouts 10 and 12, after securing the block 26 to the frame plate 2B with the screw 22, the block 26 is effectively, and efficiently, secured in three dimension with respect to the frame plate 2B.

Figure 5A:
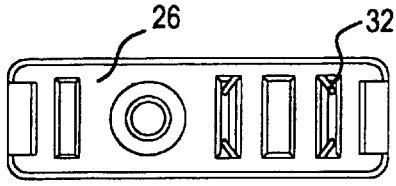
FIGS. 5A, 5B, 5C show a front, side and rear view, respectively, of the terminal block of FIG. 3, in cooperation with terminal members.
Figure 5B:
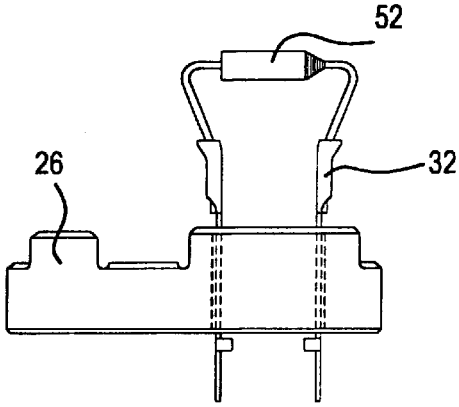
Figure 5C:
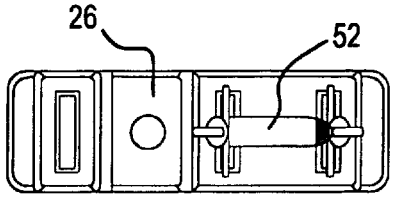

Referring to FIGS. 1, 2, and 5, an example sequence of assembly will be described. First, the first multi-terminal block 26 is secured to the frame plate 2B using the mounting screw 22. Next, the crimping structure of the third terminal member 32C is crimped to the first wire terminal of the TCO 52, and the crimping structure of the second terminal member 32B is crimped to the second wire terminal of the TCO. Next, the assembly of the TCO 52 and the second and third terminal members 32B and 32C is inserted into the insulating multi-terminal block 26, by inserting the third multi-terminal member 32C into the hole 28C and the second multi-terminal member 32B into the hole 28B until their respective deformable tabs are above the upper face of the multi-terminal block. As described above, the deformable tab on each of the terminal members 32B and 32C is then deformed into the position shown in FIGS. 1 and 5, thereby locking 32B and 32C within the insulating multi-terminal block 26.

Next, the crimping structure of the first terminal member 32A is crimped onto the terminal end of the resistive heating wire 6. The first terminal member 32A is then inserted into the first terminal through hole 28A in the insulating multi-terminal block, and its deformable tab bent as described for the second and third terminal members above.

Figure 6C:
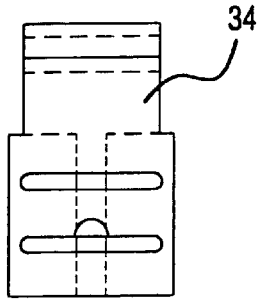
FIGS. 6A, 6B, and 6C show a front, bottom, and side view of a unitary jumper member of the heater assembly of FIG. 1.
Figure 6A:
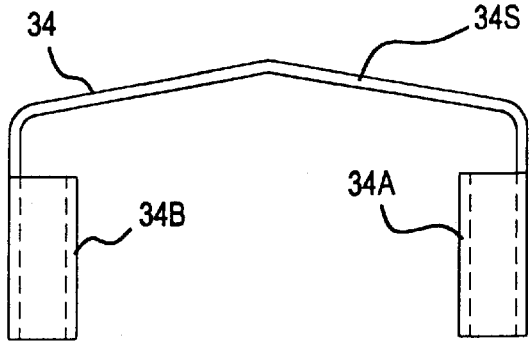
Figure 6B:
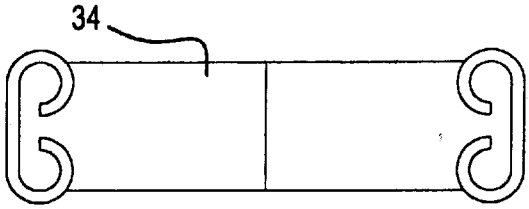

A unitary conducting strap, or jumper strap 34, which is shown in greater detail in FIG. 6, is then installed onto the connection end of the first and second terminal member 32A and 32B as shown in FIG. 1. Referring to FIG. 5, the unitary jumper strap 34 includes a metal strap 34S with a first crimping end 34A and a second crimping end 34B at its opposite ends. The first and second crimping ends are preferably welded to the strap 34S.

The above-described assembly embodies, in a single integrated assembly, the external power connection, which is the function of the connection structure of the third terminal member 32C, together with the TCO 52, as well as the connection to the resistive wire end 6A by its being crimped within the first terminal member 32A. The described assembly uses only the single screw 22, the single unitary jumper strap 34, one ceramic multi-terminal block 26 and three identical terminal members 32. There is no welding, soldering or brazing required, and all jumper wires are eliminated.

Figure 7A:
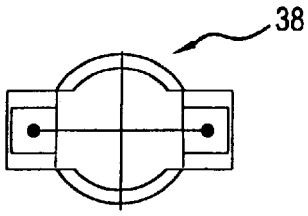
FIGS. 7A, 7B, and 7C show a rear, side, and partial side view of a thermostat of the heater assembly of FIG. 1.
Figure 7C:
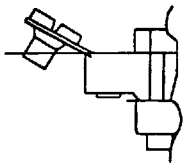
Figure 7B:
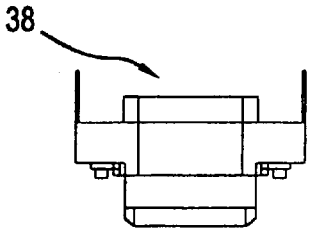

Referring again to FIGS. 1 and 7, a further embodiment using another unitary jumper strap, labeled as 36, and a fourth of the terminal members 32, labeled as 32D, to mount a thermostat 38, and to effect another external power connection, and to connect that external power connection to the other end 6B of the resistive wire 6 will be described. This embodiment can be utilized independent of the above-described embodiment, or in combination with the same. As will be understood from the description, and the referenced drawings, one significant benefit of this embodiment, which is independent of the embodiment above, is that it mounts the thermostat 38 to the frame 2B with a single screw 24. Another benefit is obtained from the unitary jumper strap 36, in that it accommodates variances in height of the terminals of the thermostat 38, without reliability problems associated with wire jumpers.

Referring to FIG. 1, an example of this embodiment includes a terminal bushing 40, the fourth terminal member 32D, the second unitary jumper 36, the thermostat 38, and a thermostat mounting screw 24. The depicted thermostat 38 has a main housing, a flanged housing portion, a first terminal 38A and a second terminal 38B. The example flanged housing portion may be metal and secured to the main housing by a plurality of indentations. The flanged housing portion has an outer flange 38FLG having a major diameter. Referring to FIGS. 1 and 2, the major diameter is larger than the diameter of cutout 14 by an amount such that the mounting screw 24 can compress the flanged housing portion against the frame plate 2B, thereby securing the thermostat in position.

The terminal bushing 40 may include two constituent parts, which are upper bushing member 40A and lower bushing member 40B. The two members 40A and 40B are inserted through the cutout 16 in the frame plate 2B, assembled and locked in position by the fourth terminal member 32D. The lower bushing member 40B may include a round flange and a square portion. The upper bushing member 40A may include a round flange and a square recess to accommodate the distal portion of the square portion of the lower bushing member 40B.

Referring to FIGS. 1 and 2, the cutout 16 provides clearance for, and prevents rotation of the bottom portion 40B of the terminal bushing 40. A terminal member through hole passes through the center of the upper and lower components of the terminal bushing 40. Because of 32D preferably having the same structure as 32A–32C, the terminal through hole in the bushing 40 is preferably dimensioned the same as the terminal through holes 28 formed in the terminal block 26. The height of the assembled terminal bushing may be the same as the height of the multi-terminal block 26, due to 32D being the same as 32A–32C.

Referring to FIGS. 1, and 2, an example sequence of assembly will be described. The described sequence is for purposes of example only. First, the thermostat 38 is inserted into the cutout 14 in the orientation shown in FIG. 1. Next, mounting screw 24 is inserted into the hole and tightened. Mounting screw 24 is preferably a self-threading screw, readily selected from among commercially available screws by one of ordinary skill in the relevant art. Next, the crimping end of the fourth terminal member 32D is crimped onto the terminal 6B of the resistive heating wire 6. Next, the lower member 40B of the terminal bushing 40 is inserted through the cut-out 16, and the upper member 40A is placed over the distal portion of the shaft that protrudes through the cut-out 16. The upper and lower bushing members 40A and 40B are oriented so that the terminal through hole is aligned in the direction shown in FIG. 1.

Next, the fourth terminal member 32D is inserted through the assembled top and bottom components of the terminal bushing 40 until the deformable tabs are above the top surface of the bushing's top component 40A. The deformable tabs are then bent to the form shown in FIGS. 1 and 5, thereby locking the fourth terminal member 32D, and top and bottom components of the terminal bushing together as shown in FIG. 1.

The second unitary jumper strap 36, preferably identical to the structure shown in FIG. 6, is then installed onto the connection end of the fourth terminal member 32D and to the first terminal 38A of the thermostat 38. Referring to FIG. 1, a benefit of the unitary jumper strap 36 is that it can accommodate a difference in height of the fourth terminal member 32D above the frame plate 2B, and the height of the terminal 38A of the thermostat 38.

The form and structure of the terminal bushing 40 depicted in FIG. 1 is for purposes of example, and is not the only structure contemplated by the invention for mounting the fourth terminal member 32D. For example, instead of the two-piece structure, an alternative terminal bushing could be rectangular, formed similar to the structure of the multi-terminal block 26, but having only one through hole, such as item 28, and a mounting hole, such as the mounting hole 30. This terminal bushing would be secured to the frame plate 2B by a screw similar to the mounting screw 24.

The foregoing presentation of the described embodiments is provided to enable any person skilled in the art to make or use the present invention. Various modifications to these embodiments are possible, and the generic principles presented herein may be applied to other embodiments as well. As such, the present invention is not intended to be limited to the embodiments shown above, and/or any particular configuration of structure but rather is to be accorded the widest scope consistent with the principles and novel features disclosed in any fashion herein.

What is claimed is:

1. A conductive metal u-shaped jumper strap comprising:

a) a plate portion having a width, length, and thickness, the plate portion having a bent portion at a middle part thereof, and b) a pair of connection legs, wherein the plate portion and the connection legs form the u-shape and the connection legs can link to a pair of spaced apart terminals, each connection leg further comprising:

i) an upper leg plate portion extending from the plate portion at a bend; and ii) a lower connection portion extending from the upper leg plate portion, the lower connection portion having a back and a pair of flexible crimping portions, the back and crimping portions forming a cavity to receive a terminal end for electrical connection purposes;

c) wherein the strap portion can bend so that the connection legs can link to spaced apart terminals with variable spacing by adjusting the amount of bend in the bent portion of the plate portion.

2. The jumper strap of claim 1, wherein each crimping portions is welded to the upper leg plate portion.

3. The jumper strap of claim 1, wherein the crimping portions of each lower connection portion are curved flanges extending from the back and terminating with a free end facing the back.

4. A method of electrically connecting a pair of terminals together comprising:

a) providing a u-shaped jumper strap having a center plate portion with a bend therein, and a pair of connection legs, the connection legs defining a set terminal spacing;

b) crimping the connection legs to the pair of terminals wherein the bend in the center plate portion is adjusted to accommodate another terminal spacing larger or smaller than the set spacing.

5. The method of claim 4, wherein each connection leg further comprises:

i) an upper leg plate portion extending from the plate portion at a bend; and ii) a lower connection portion extending from the upper leg plate portion, the lower connection portion having back and a pair of flexible crimping portions, the back and crimping portions forming a cavity to receive a terminal end of the terminal for electrical connection purposes.

6. A conductive metal u-shaped jumper strap comprising:

a) a u-shaped jumper strap having a center plate portion with a first bend therein and a pair of leg portions, each leg portion extending from a second bend, the leg portions defining a terminal spacing; and b) a pair of terminal connecting portions, each terminal connecting portion extending from a respective leg portion;

c) wherein the first bend in the plate portion is adjustable to vary the terminal spacing so that the terminal connecting portions can attach to terminal connections of different spacings.

7. The jumper strap of claim 6, wherein each terminal connecting portion is welded to each leg portion.

8. The jumper strap of claim 6, wherein each terminal connecting portion comprises a back and a pair of flexible crimping portions.

* * * * *